US009931859B2

(12) United States Patent
Ring et al.

(10) Patent No.: US 9,931,859 B2
(45) Date of Patent: Apr. 3, 2018

(54) REMOVING AIR FROM A PRINTING FLUID CHANNEL

(71) Applicant: Hewlett-Packard Development Company, L.P., Houston, TX (US)

(72) Inventors: James W. Ring, Blodgett, OR (US); Rhonda Lynn Wilson, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/114,971

(22) PCT Filed: Jan. 31, 2014

(86) PCT No.: PCT/US2014/014017
§ 371 (c)(1),
(2) Date: Jul. 28, 2016

(87) PCT Pub. No.: WO2015/116132
PCT Pub. Date: Aug. 6, 2015

(65) Prior Publication Data
US 2017/0050445 A1 Feb. 23, 2017

(51) Int. Cl.
*B41J 2/19* (2006.01)
*B41J 2/175* (2006.01)

(52) U.S. Cl.
CPC ..... *B41J 2/19* (2013.01); *B41J 2/175* (2013.01); *B41J 2/17509* (2013.01)

(58) Field of Classification Search
CPC ..... B41J 2/19; B41J 2/175; B41J 2/17509
See application file for complete search history.

(56) References Cited

U.S. PATENT DOCUMENTS

| | | | | |
|---|---|---|---|---|
| 6,068,370 | A * | 5/2000 | Miller | B41J 2/175 347/85 |
| 6,874,873 | B2 | 4/2005 | Thielman et al. | |
| 7,344,230 | B2 | 3/2008 | Moynihan | |
| 7,360,882 | B2 | 4/2008 | Ikeda et al. | |
| 8,020,982 | B2 | 9/2011 | Mun et al. | |
| 8,047,644 | B2 | 11/2011 | Ikeda et al. | |
| 8,465,139 | B2 | 6/2013 | Price et al. | |
| 8,967,769 | B1 * | 3/2015 | Dowell | B41J 2/155 347/40 |

(Continued)

FOREIGN PATENT DOCUMENTS

WO WO-2012148412 11/2012

OTHER PUBLICATIONS van der Bos, A., et al. "Infrared imaging and acoustic sizing of a bubble inside a micro-electro-mechanical system piezo ink channel." Journal of applied physics 110, No. 3 (2011): 034503.

*Primary Examiner* — Jason Uhlenhake
(74) *Attorney, Agent, or Firm* — HP Inc. Patent Department

(57) ABSTRACT

In one example, a processor readable medium has instructions thereon that when executed cause a printer to: introduce an unsaturated printing fluid into a channel through which fluid may pass to a printhead; dispense unsaturated printing fluid with the printhead to remove air from the channel; and then introduce regular printing fluid into the channel; and dispense printing fluid with the printhead until regular printing fluid is dispensed from the printhead.

18 Claims, 10 Drawing Sheets

(56) References Cited

U.S. PATENT DOCUMENTS

| | | | | |
|---|---|---|---|---|
| 2001/0024223 | A1* | 9/2001 | Thielman | B41J 2/17509 347/85 |
| 2003/0076388 | A1 | 4/2003 | Waggoner et al. | |
| 2007/0046747 | A1 | 3/2007 | Takemoto | |
| 2013/0176359 | A1* | 7/2013 | Roberts | B41J 2/16526 347/28 |
| 2013/0235121 | A1* | 9/2013 | Gras | B41J 2/16552 347/25 |

* cited by examiner

REMOVING AIR FROM A PRINTING FLUID CHANNEL

CROSS-REFERENCE TO RELATED APPLICATION

This application is a U.S. National Stage Application of and claims priority to International Patent Application No. PCT/US2014/014017, filed on Jan. 31, 2014, and entitled "REMOVING AIR FROM A PRINTING FLUID CHANNEL," which is hereby incorporated by reference in its entirety.

BACKGROUND

In some inkjet printers, a substrate wide print bar is used to print on paper or other print substrates moved past the print bar. Inkjet print bars usually include multi-part flow structures with channels for ink to flow from the supply to a printhead or to multiple printheads.

DRAWINGS

The same part numbers designate the same or similar parts throughout the figures.

DESCRIPTION

Figure 1:
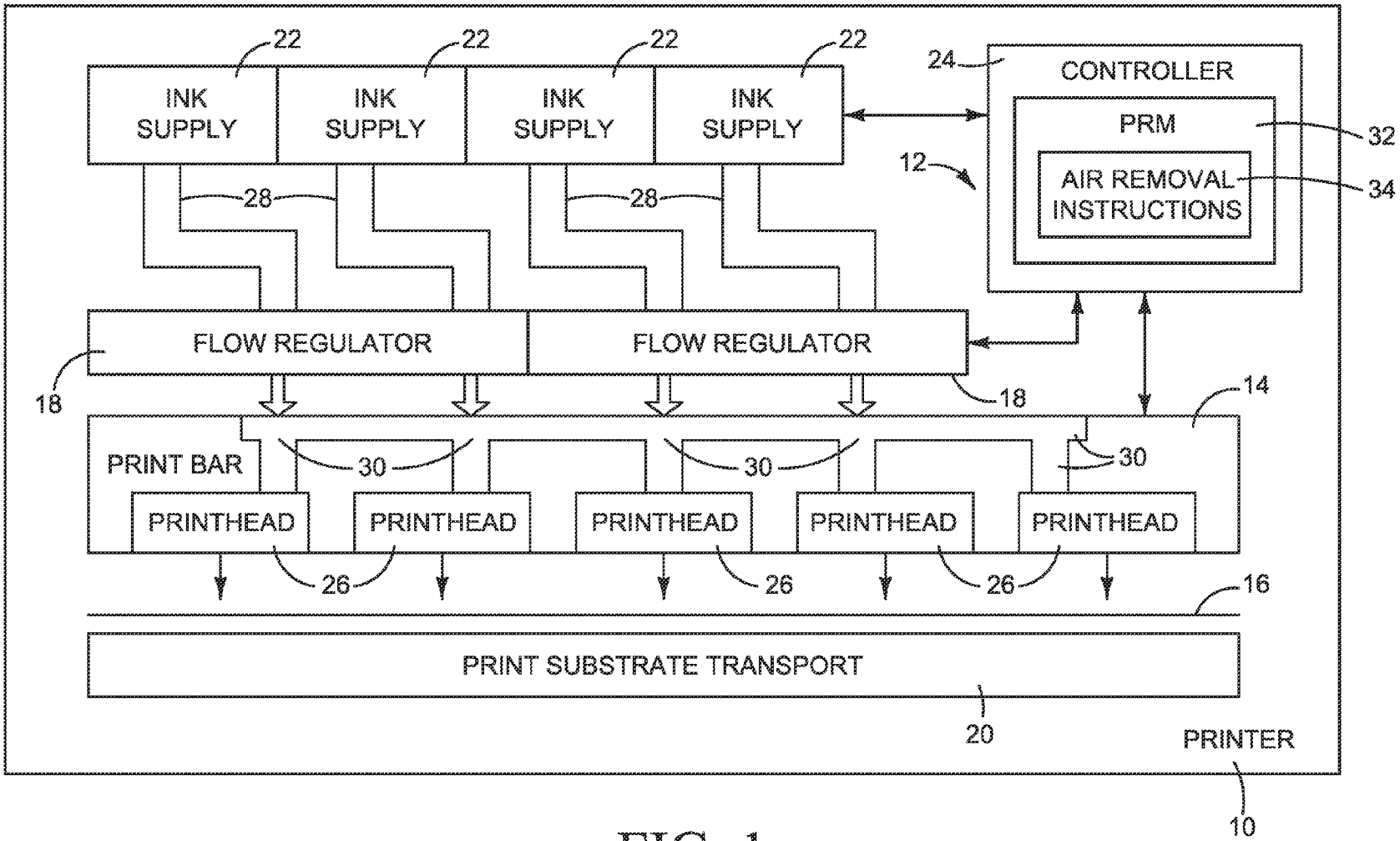
FIGS. 1 and 2 are block diagrams illustrating an inkjet printer implementing one example of a new air removal system.

Too much air in the flow channels in an inkjet print bar can inhibit the flow of ink to the printheads, causing the printheads to perform poorly. A new technique has been developed to reduce the amount of air in the fluid flow channels in an inkjet print bar. In one example, unsaturated printing fluid is introduced into the print bar flow channels and dispensed from the printheads so that air is absorbed into the unsaturated printing fluid as it moves through the flow channels to the printheads. Once the desired quantify of air is removed from the flow channels, regular printing fluid is introduced into the flow channels and printing fluid dispensed from the printheads until the regular printing fluid reaches the printheads to begin normal printing. In one example, air removal programming resides on the printer controller to perform air removal using service cartridges (with unsaturated printing fluid) installed into the print bar in place of the regular printing fluid supply cartridges. In another example, air removal is performed at the direction of programming that resides at a service center using a service module that supplies unsaturated printing fluid to the print bar flow channels.

Unlike printers that use replaceable, scanning printheads, substrate wide print bars are usually designed as a permanent part of the printer. Removing air from the flow channels in a substrate wide print bar not only helps improve print quality, but it also helps extend the useful life of the print bar and thus the printer too. Air removal may be performed before regular printing during the initial printer set-up to remove air that may have accumulated in the flow channels during storage and shipping. Air removal may be performed periodically throughout the life of the printer to remove air that can accumulate during use. Air may be removed using examples of the new technique without removing the print bar from the printer, thus saving time and minimizing the risk of damaging the print bar.

Although examples are described with reference to a substrate wide print bar, examples may be implemented in other inkjet type dispensing devices. Accordingly, the examples described in this Description and shown in the Drawings illustrate but do not limit the disclosure, which is defined in the Claims following this Description.

As used in this document, a "printhead" means that part of an inkjet printer or other inkjet type dispenser for dispensing a printing fluid, for example as drops or streams; a "print bar" means a usually elongated structure or device holding a single printhead or multiple printheads that remains stationary during printing; "printing fluid" means a fluid that may be dispensed from a printhead including, for example, ink and shipping fluid; "regular" printing fluid means printing fluid used for normal printing or other normal dispensing operations; and "unsaturated" printing fluid means a printing fluid that can absorb air as it passes through a flow channel in a print bar or other inkjet type dispensing device. While the air saturation level for "unsaturated" printing fluid may vary depending on the characteristics of the printing fluid and dispensing device, it is expected that an air saturation level less than 70% usually will be needed for effective air removal and that an air saturation level less than 50% usually will be desirable for faster air removal. Although regular printing fluid usually will be saturated printing fluid, an unsaturated printing fluid could also be used as the regular printing fluid. "Printhead" and "print bar" are not limited to printing with ink but also include inkjet type dispensing of other fluids and/or for uses other than printing.

Figure 2:
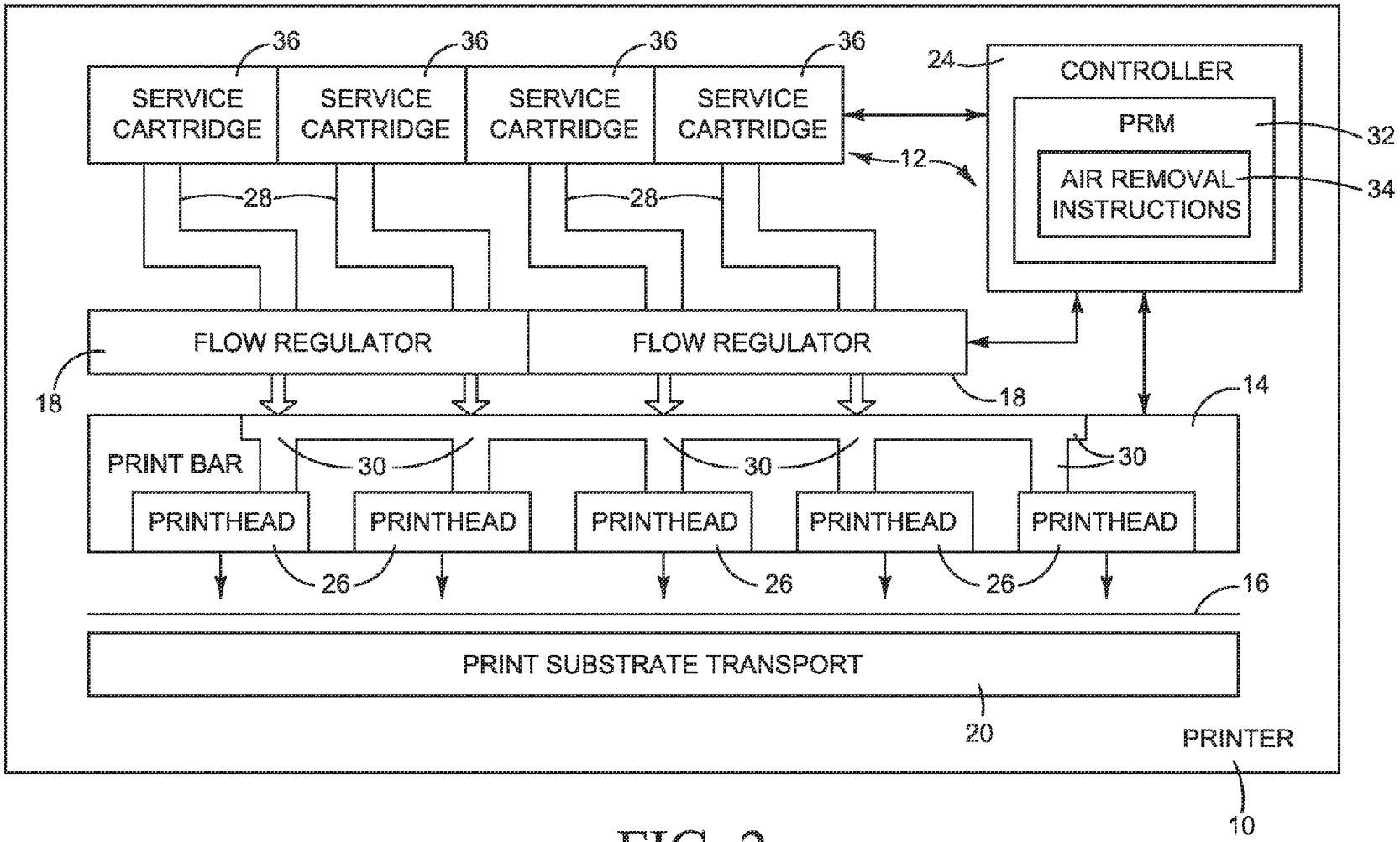

FIGS. 1 and 2 are block diagrams illustrating an inkjet printer 10 implementing one example of an air removal system 12. Referring first to FIG. 1, printer 10 includes a print bar 14 spanning the width of a print substrate 16, flow regulators 18 associated with print bar 14, a substrate transport mechanism 20, ink or other regular printing fluid supplies 22, and a printer controller 24. Print bar 14 includes printheads 26 for dispensing printing fluid on to a sheet or continuous web of paper or other print substrate 16. Although five printheads 26 are shown, more or fewer printheads 26 may be used. Printheads 26 receive printing fluid through a typically complex flow path that includes channels 28 from printing fluid supplies 22 into and through flow regulators 16, and channels 30 in print bar 14. For example, each channel 28 might carry ink from a corresponding cyan, magenta, yellow and black (CMYK) ink supply 22 to a flow regulator 18 which delivers the ink to print bar 14 where each color ink is distributed to printheads 26 through channels 30. While regulators 18 and channels 28 are shown separate from print bar 14, one or both of regulators 18 and channels 28 could be integrated into print bar 14.

Controller 24 represents the processor(s) and associated memory(ies) and instructions, and the electronic circuitry and components needed to control the operative elements of printer 10. In particular, controller 24 includes a processor readable medium (PRM) 32 with instructions 34 for controlling the removal of air from channels 28 and 30. Control functions for many printers, particularly printers for small business and personal use, are implemented in application specific integrated circuits (ASICs). Accordingly, some or all of the functionality of controller 24 in printer 10, including PRM 32 and air removal instructions 34, may be implemented in an ASIC. However, other suitable implementations for PRM 32 and instructions 34 are possible.

Referring now to FIG. 2, for air removal each regular printing fluid supply 20 is replaced with a service cartridge 36 containing unsaturated printing fluid. Air removal system 12 includes service cartridges 36 and air removal instructions 34 on a controller PRM 32. In one example, the unsaturated printing fluid is shipping fluid. In another example, the unsaturated printing fluid is ink. Once the air removal is complete, as described below with reference to the flow diagrams of FIGS. 9-12, service cartridges 36 are removed and regular printing fluid supplies 22 are installed for normal printing.

Figure 3:
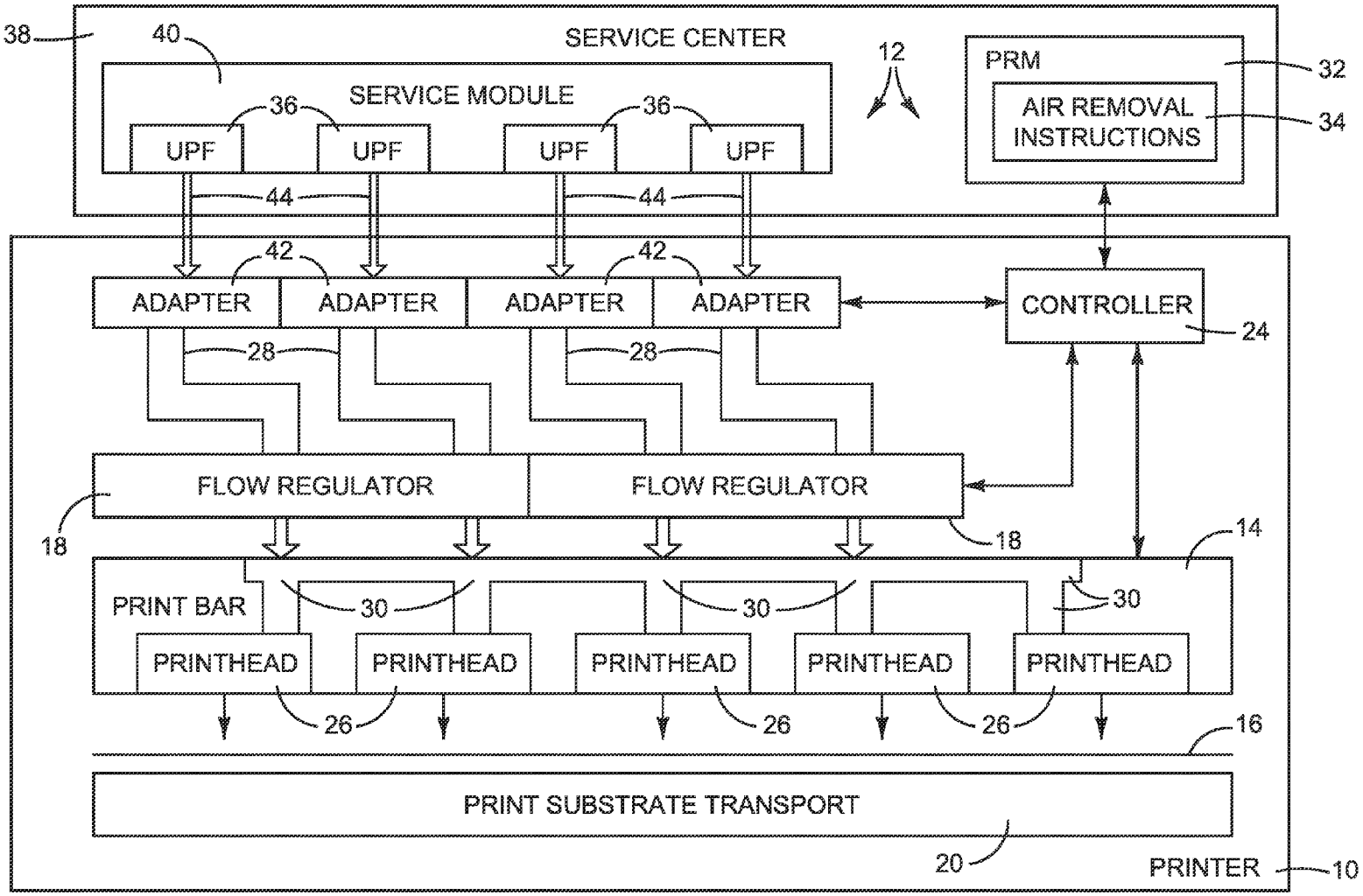
FIG. 3 is a block diagram illustrating an inkjet printer implementing another example of the new air removal system.

FIG. 3 is a block diagram illustrating an inkjet printer 10 implementing another example of an air removal system 12. In this example, and referring to FIG. 3, processor readable medium 32 with air removal instructions 34 resides at a service center 38 that is operatively connected to printer 10 for air removal. Service center 38 also includes a service module 40 with unsaturated printing fluid supplies (UPF) 36. Air removal system 12 in FIG. 3 includes service module 40 with UPF supplies 36 and instructions 34 on a service center PRM 32. For air removal, each unsaturated printing fluid supply 36 is connected to a corresponding flow channel 28 through adapters 42. Although four adapters 42 are shown in the example of FIG. 3, each corresponding to one of the supplies 36, other adapter configurations are possible. For example, a single adapter with multiple ports to connect supplies 36 to channels 28 could be used.

Service cartridges 36 in FIG. 2 and UPF supplies 36 in FIG. 3 represent any suitable source of unsaturated printing fluid. For example, unsaturated printing fluid may be introduced into channels 28 directly from containers specially designed to maintain unsaturated printing fluid. For another example, an in-line degasser (degassers 53 in FIG. 8) may be interposed between channels 28 and containers of saturated printing fluid to deliver unsaturated printing fluid to channels 28. Also, air removal instructions 34 need not reside solely on a processor readable medium 32 on printer controller 24 or at a service center 38 (or other site or device separate from printer 10). Similarly, one processor or multiple processors on controller 24 or separate from controller 24 (or both) may be used to execute instructions 34. Accordingly, suitable configurations other than those shown for storing and executing air removal instructions 34 are possible.

Figure 4:
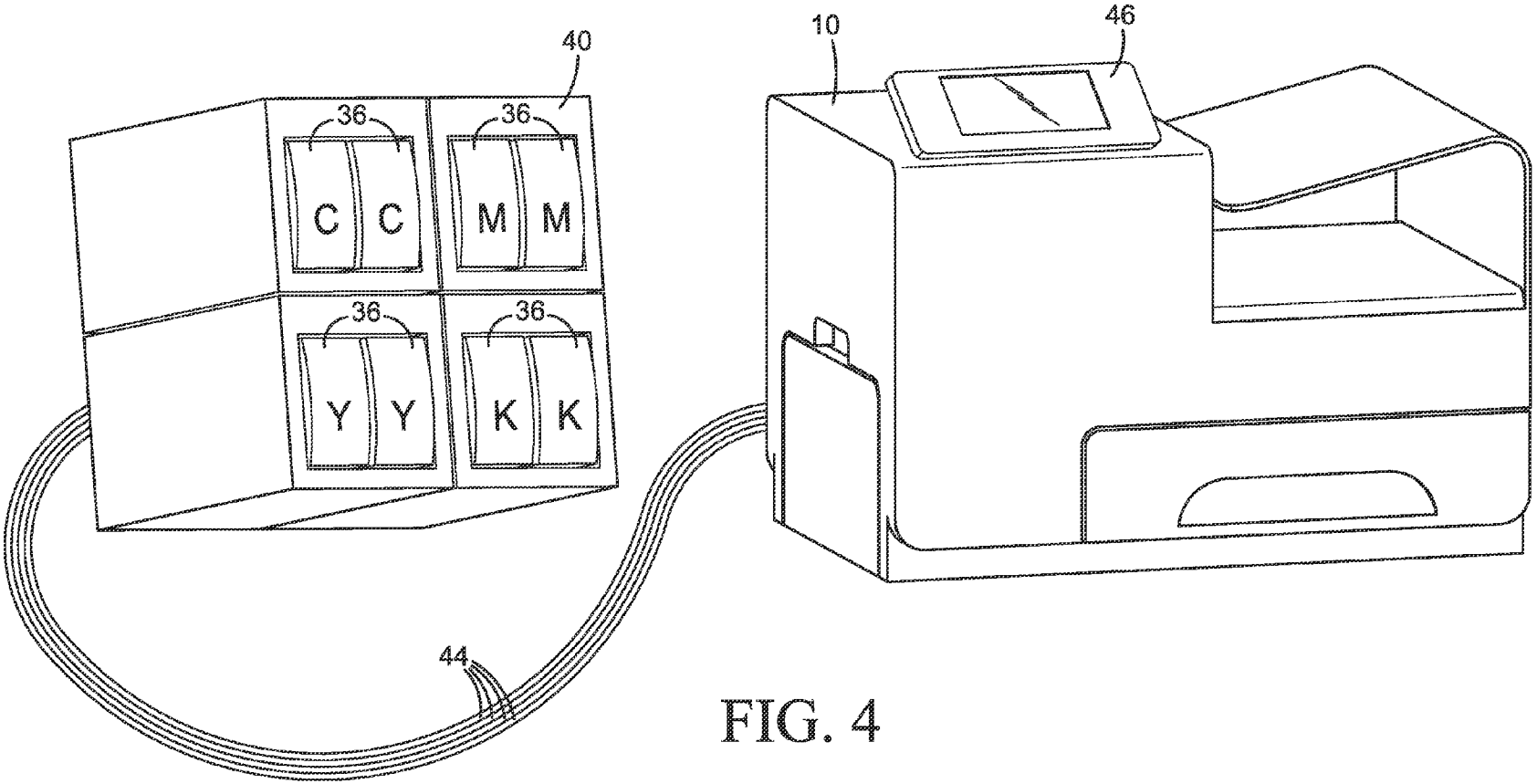
FIG. 4 is a perspective view illustrating a printer and service module such as might be used in the air removal system shown in FIG. 3.
Figure 5:
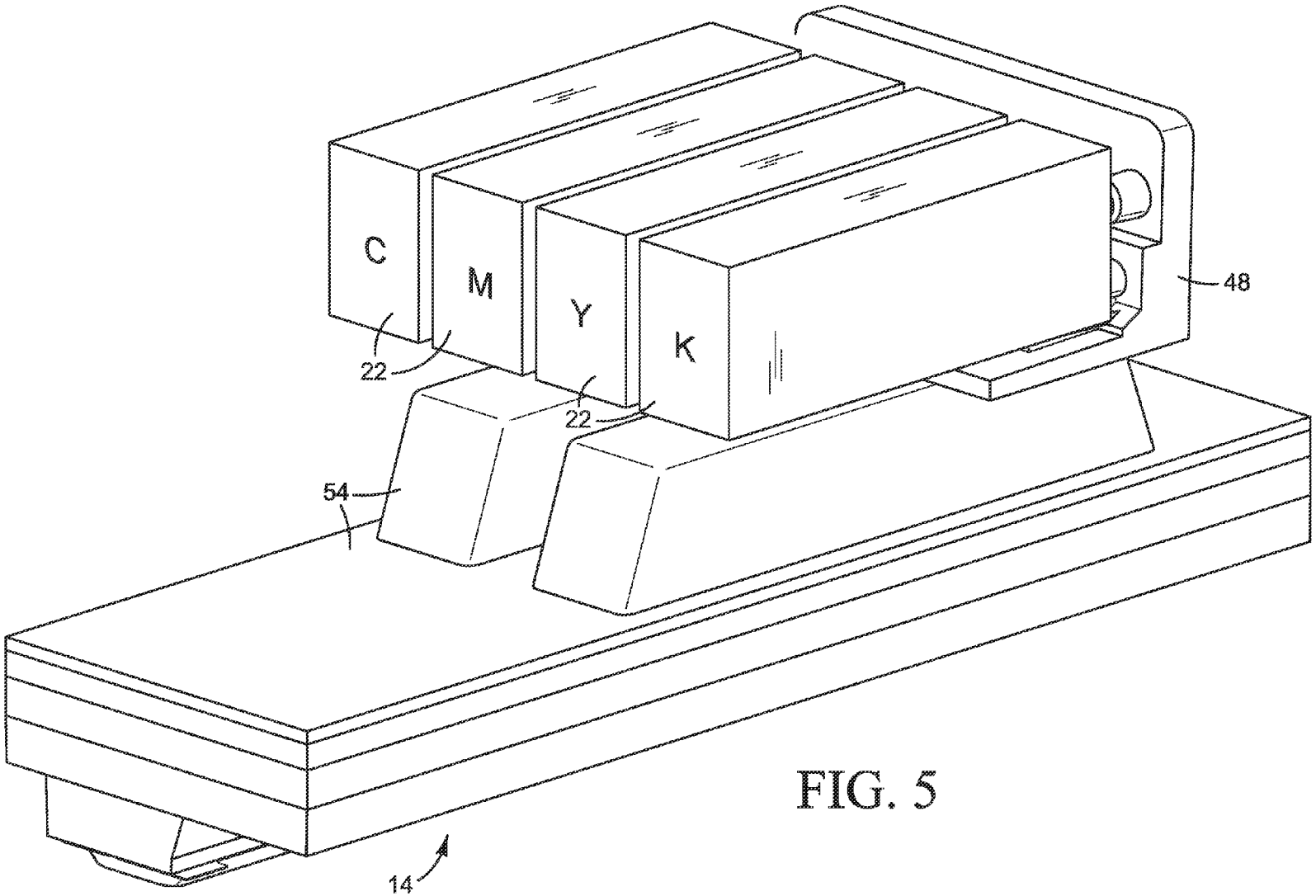
FIGS. 5-8 are perspective views illustrating one example of a print bar such as might be used in the printer shown in FIG. 4.
Figure 6:
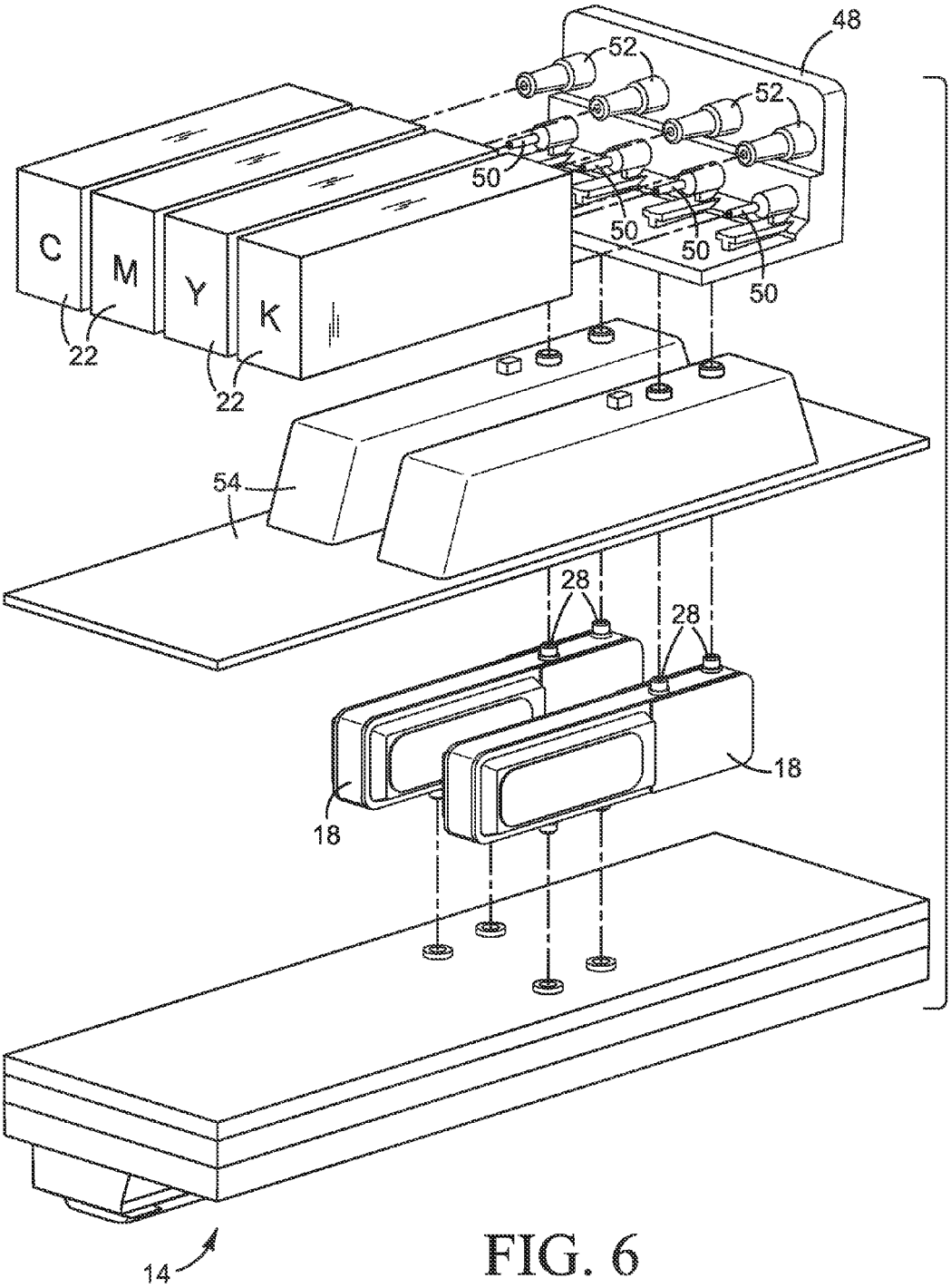
Figure 7:
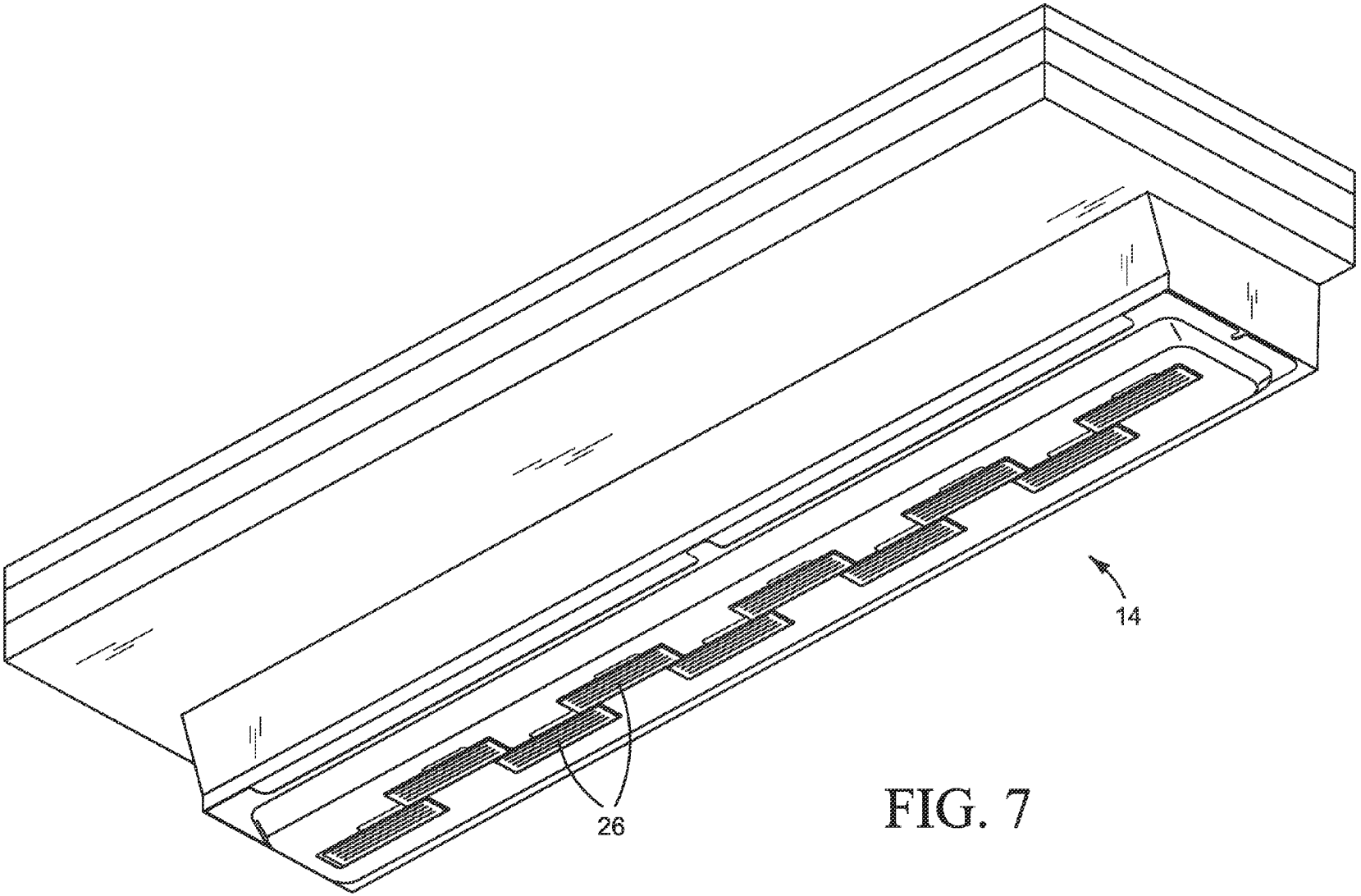

FIG. 4 is a perspective view illustrating a printer 10 and service module 40 such as might be used in the air removal system 12 shown in FIG. 3. FIG. 5 is a top view of one example of a print bar 14 such as might be used in the printer 10 shown in FIG. 3. FIG. 6 is an exploded view of print bar 14 in FIG. 5. Regular printing fluid supplies 22 are installed in print bar 14 for normal printing operations in FIGS. 5 and 6. FIG. 7 is a bottom view of print bar 14 showing one example arrangement for printheads 26 and FIG. 8 is an exploded top view of print bar 14 with an air removal adapter 42 installed in place of the regular printing fluid supplies.

Referring first to FIGS. 4-6, for normal printing operations print bar 14 in printer 10 includes regular printing fluid supply cartridges 22, for example to supply cyan, magenta, yellow and black (CMYK) ink. Supply cartridges 22 are held in a support 48 and connected to printing fluid ports 50 and air ports 52. Printing fluid flows from supply cartridges 22 to flow regulators 18 through ports 50 and channels 28. In this example, as shown in FIGS. 5 and 6, flow regulators 18 are housed on top of print bar 14 in a housing 54 and cartridge support 48 is mounted to housing 54.

Figure 8:
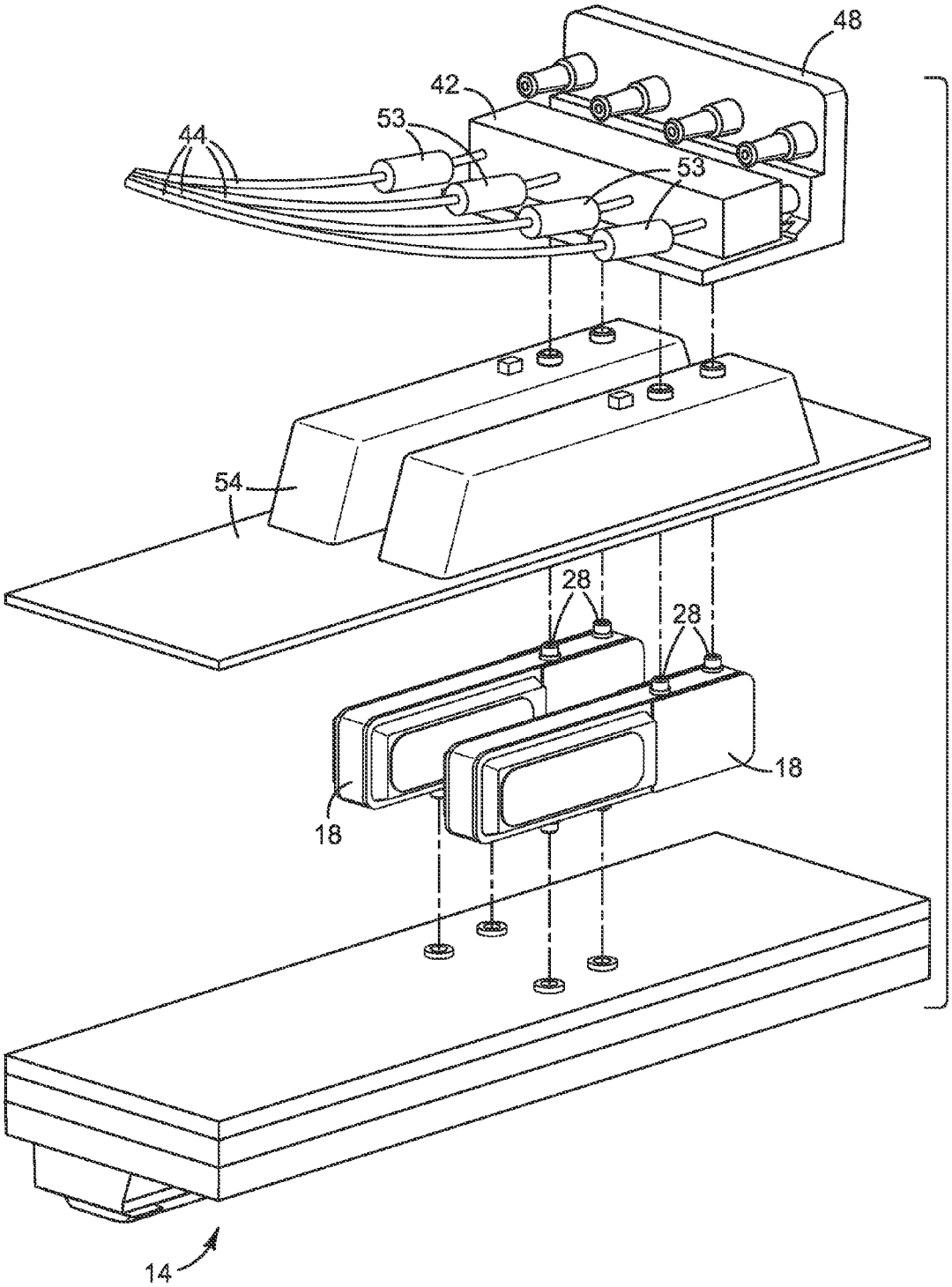

Referring now to FIGS. 4 and 8, for air removal regular printing fluid supply cartridges 22 are removed and a service module 40 with unsaturated printing fluid supplies 36 is connected to printing fluid ports 50 through adapter 42 and tubes 44. In this example, the unsaturated printing fluid is ink the same color (CMYK) as the ink used for normal printing and system 12 includes an in-line degasser 53 for each color. Once air removal is complete, adapter 42 is disconnected and regular printing fluid supplies 22 installed for normal printing.

Figure 9:
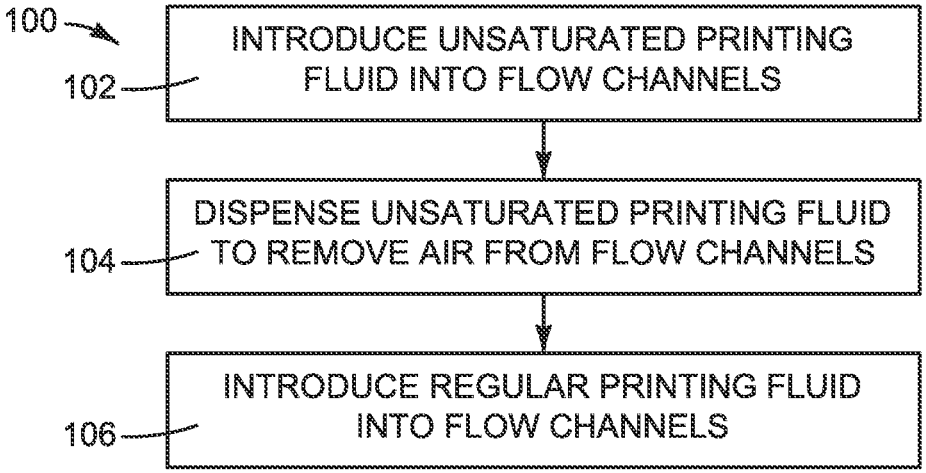
FIG. 9 is a flow diagram illustrating one example of a method for removing air from a printing fluid channel such as might be implemented with the air removal system shown in FIGS. 1 and 2 or the air removal system shown in FIG. 3.

FIG. 9 is a flow diagram illustrating one example of a method 100 for removing air from a printing fluid channel such as might be implemented in a system 12 shown in FIGS. 1 and 2 or a system 12 shown in FIG. 3. The method of FIG. 9 may be performed, for example, at the direction of controller 24 executing air removal instructions 34. Air removal instructions 34 may be embodied in a local PRM 32 residing on controller 24 as shown in FIGS. 1 and 2, or in a PRM 32 separate from controller 24, for example at a service center 38 shown in FIG. 3. Referring to FIG. 9, unsaturated printing fluid is introduced into flow channels 28 and 30 (block 102) and dispensed with some or all printheads 26 to remove air from the channels (block 104). Once the desired amount of air is removed, regular printing fluid is introduced into channels 28 and 30 (block 106). Where the unsaturated printing fluid is usable for normal printing, it may not be necessary or desirable to introduce the regular printing fluid into print bar channels 30 as part of the air removal operation shown in FIG. 9.

Referring again to FIGS. 2 and 3, as printing fluid is dispensed from printheads 26, the unsaturated printing fluid moving through channels 28 and 30 will absorb air and carry it to printheads 26 where it is discharged from print bar 14. As the unsaturated printing fluid absorbs air on its way to printheads 26, it may become saturated with air. Thus, the character of the unsaturated printing fluid may change from unsaturated to saturated at times during the air removal operation as it moves to printheads 26. The step of dispensing "unsaturated" printing fluid at block 104 in FIG. 9 includes any such change in character. That is to say, dispensing "unsaturated" printing fluid includes dispensing saturated printing fluid that originated upstream from the printheads as unsaturated printing fluid.

Figure 10:
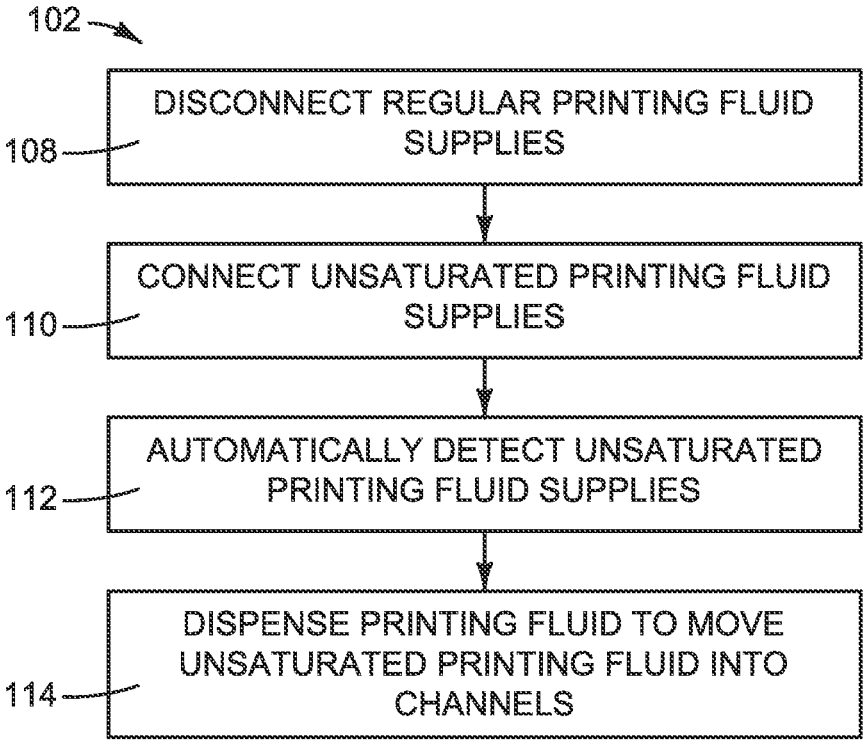
FIG. 10 is a flow diagram illustrating one example for introducing unsaturated printing fluid into the flow channels in the method of FIG. 9.

FIG. 10 is a flow diagram illustrating one example for introducing unsaturated printing fluid into flow channels 28 and 30 at block 102 in FIG. 9. Referring to FIG. 10, regular printing fluid supplies 22 in FIG. 1 are disconnected from print bar 14 (block 108) and unsaturated printing fluid supplies 36 are connected to print bar 14 as shown in FIG. 2 (block 110). The unsaturated printing fluid supplies 36 are automatically detected by controller 24 (block 112) and then printing fluid is dispensed from some of all of printheads 26 to move unsaturated printing fluid into channels 28 and 30 (block 114). The disconnecting and connecting actions at blocks 108 and 110 are user actions while the detecting and dispensing actions at blocks 112 and 114 are printer actions undertaken at the direction of controller 24. Alternatively, the step of automatically detecting the unsaturated printing fluid supplies to initiate dispensing may be omitted and, instead, the user can manually initiate dispensing after connecting the unsaturated printing fluid supplies by entering a command at the printer control panel 46 (FIG. 4). Also, where the air removal operation is performed before the regular printing fluid supplies have been connected, during initial printer setup for example, then disconnecting the regular printing fluid supplies at block 108 is omitted.

Figure 11:
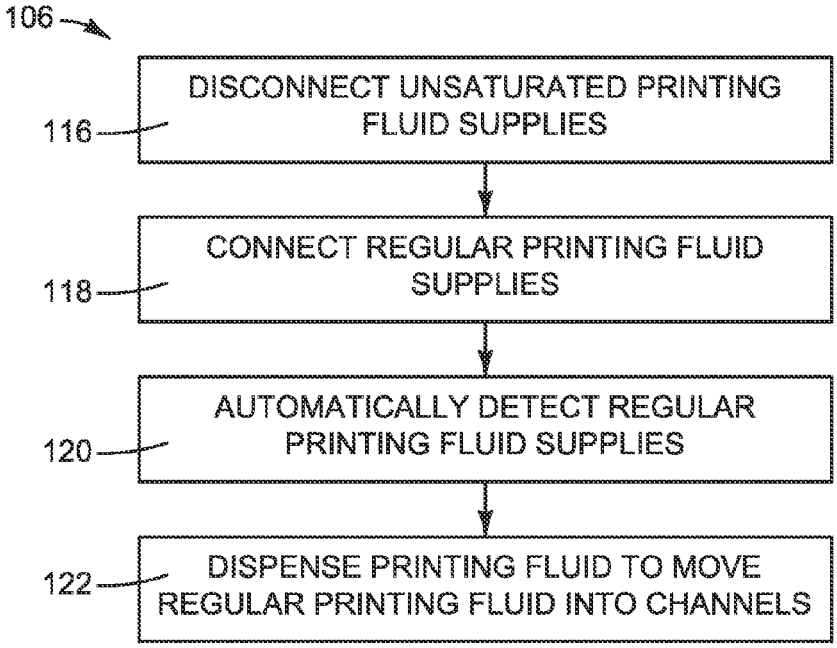
FIG. 11 is a flow diagram illustrating one example for introducing regular printing fluid into the flow channels in the method of FIG. 9.

FIG. 11 is a flow diagram illustrating one example for introducing regular printing fluid into flow channels 28 at block 106 in FIG. 9. Referring to FIG. 11, unsaturated printing fluid supplies 36 in FIG. 2 or FIG. 3 are disconnected from print bar 14 (block 116) and regular printing fluid supplies 22 are connected to print bar 14 as shown in FIG. 1 (block 118). The regular printing fluid supplies 22 are automatically detected by controller 24 (block 120) and then printing fluid is dispensed from some of all of printheads 26 to move regular printing fluid into channels 28 and 30 (block 122). The disconnecting and connecting actions at blocks 116 and 118 are user actions while the detecting and dispensing actions at blocks 120 and 122 are printer actions undertaken at the direction of controller 24. Alternatively, the step of automatically detecting the regular printing fluid supplies to initiate dispensing may be omitted and, instead, the user can manually initiate dispensing after connecting the regular printing supplies by entering a command at the printer control panel 46 (FIG. 4).

Most ink cartridges and other inkjet printing fluid supplies now include an electronic chip that identifies the supply and stores information about the supply. Electrical contacts on the chip connect to mating contacts on the printer to allow the printer controller to automatically detect the presence of a printing fluid supply, identify the supply, and obtain information about the supply. A similar electronic chip on the service cartridges 36 and the adapter(s) 42 may be used to allow the printer controller to automatically detect the presence of a service cartridge/adapter, to identify the cartridge/adapter and to obtain information about the unsaturated printing fluid used for air removal.

The air removal operation continues until a threshold amount of air is removed from the channels. While it is expected that substantially all of the air usually will be removed from the channels, a lower threshold might also be used. "Substantially all" in this context means all of the air that can be absorbed into the unsaturated printing fluid as the printing fluid moves through the flow channels. Ideally, the unsaturated printing fluid will absorb 100% of the air in the flow channels, but in practice the actual amount of air absorbed may be lower than 100%. In one example, the amount of air removed is determined by measuring the concentration of air in the printing fluid dispensed from the printheads. An air concentration below the saturation level indicates that substantially all air has been removed from the flow channels. In another example, the air removal process continues until a predetermined volume of unsaturated printing fluid corresponding to the desired threshold of air removal is dispensed from the printheads. Also, introducing unsaturated printing fluid rapidly into the flow channels to quickly displace a significant volume of printing fluid already in the channels can help improve the effectiveness of the air removal process. Air tends to accumulate downstream, closer to the dispensing nozzles. Introducing unsaturated printing fluid quickly for about one-half the total volume of the flow channels helps get unsaturated printing fluid to the air faster and then slowing the flow for the remainder of the air removal process allows time for the printing fluid to absorb the air.

Figure 12:
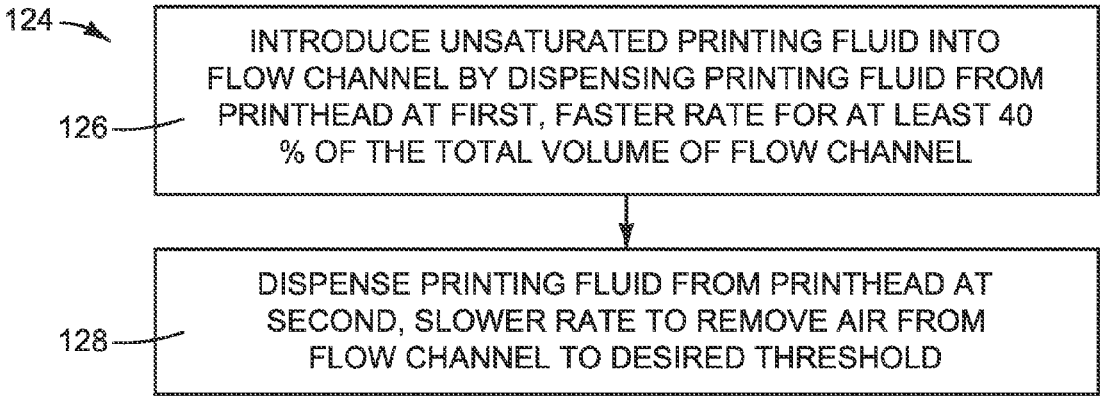
FIG. 12 is a flow diagram illustrating another example of a method for removing air from a printing fluid channel such as might be implemented with the air removal system shown in FIGS. 1 and 2 or the air removal system shown in FIG. 3

FIG. 12 is a flow diagram illustrating one example of a "fast/slow" air removal method 124 such as might be implemented in a system 12 shown in FIGS. 1 and 2 or a system 12 shown in FIG. 3. The method of FIG. 12 may be performed, for example, at the direction of controller 24 executing air removal instructions 34. Referring to FIG. 12, unsaturated printing fluid is introduced into the flow channel or into multiple flow channels by dispensing printing fluid from a printhead or from multiple printheads at a first, faster rate for about 50% of the total volume of the flow channel(s) (block 126). Then, printing fluid is dispensed from the printhead(s) at a second, slower rate to remove air from the channel(s) to the desired threshold (block 128). Once the desired threshold is reached, regular printing fluid may be introduced into the flow channel(s) to begin or resume normal printing operations.

"A" and "an" as used in the Claims means one or more.

The examples shown in the figures and described above illustrate but do not limit the disclosure, which is defined in the following Claims. Other forms, details, and examples may be made and implemented. Therefore, the foregoing description should not be construed to limit the scope of the Claims.

What is claimed is:

1. A service module, comprising:

at least one servicing fluid supply;

at least one adapter coupled to the at least one servicing fluid supply, the at least one adapter being to interface with at least one fluid port of a printer, the fluid port being to receive a printing fluid cartridge, the at least one adapter interfacing with the at least one fluid port when the fluid port is not receiving the printing fluid cartridge, the adapter being coupled to the at least one servicing fluid supply; and a processor-readable medium to couple to a processor of the printer, the processor-readable medium including instructions to cause the processor of the printer to dispense the at least one servicing fluid supply to the at least one fluid port, wherein the at least one adapter is removable from the at least one fluid port of the printer and the processor-readable medium is disconnected from the processor of the printer when the at least one adapter is removed from the at least one fluid port.

2. The service module of claim 1, wherein the servicing fluid supply includes at least one of a shipping fluid or an unsaturated printing fluid.

3. The service module of claim 1, wherein the servicing fluid has an air saturation level of less than about 70%.

4. The service module of claim 3, wherein the servicing fluid has an air saturation level of less than about 50%.

5. The service module of claim 1, wherein the at least one fluid port includes four fluid ports, and wherein the at least one adapter includes a single adapter to interface with the four fluid ports.

6. The service module of claim 5, wherein the at least one servicing fluid supply includes four servicing fluid supplies, and wherein the single adapter is coupled to the four servicing fluid supplies.

7. A system, comprising:

a printer comprising:

a print bar including at least one printhead;

at least one fluid port coupled to the at least one printhead, each fluid port to receive a printing fluid cartridge, the printing fluid cartridge containing regular printing fluid; and a processor to execute instructions; and a service module comprising:

at least one servicing fluid supply;

at least one adapter to interface with the at least one fluid port when the fluid port is not receiving the printing fluid cartridge, the adapter being coupled to the at least one servicing fluid supply; and a processor-readable medium to couple to the processor of the printer, the processor-readable medium including instructions to cause the processor of the printer to dispense the at least one servicing fluid supply to the at least one fluid port, wherein the at least one adapter of the service module is removable from the at least one fluid port of the printer and the processor-readable medium of the service module is disconnected from the processor of the printer when the at least one adapter is removed from the at least one fluid port.

8. The system of claim 7, wherein the servicing fluid supply includes a shipping fluid.

9. The system of claim 7, wherein the servicing fluid supply includes an unsaturated fluid.

10. The system of claim 9, wherein the unsaturated fluid has an air saturation level of less than about 70%.

11. The system of claim 10, wherein the unsaturated fluid has an air saturation level of less than about 50%.

12. The system of claim 7, wherein at least a portion of the service module is external to the printer.

13. The system of claim 7, wherein the at least one fluid port includes four fluid ports, and wherein the at least one adapter includes a single adapter to interface with the four fluid ports.

14. A method, comprising:

removing at least one regular printing fluid cartridge from at least one fluid port of a printer, the fluid port being in communication with a printing bar;

coupling a service module to the printer, wherein the coupling the service module to the printer includes coupling at least one adapter of the service module to the at least one fluid port and coupling a processor-readable medium of the service module to a processor of the printer, the at least one adapter being coupled to at least one servicing fluid supply of the service module;

dispensing, based on execution of instructions in the processor-readable medium of the service module by the processor of the printer, a servicing fluid from the at least one servicing fluid supply to the at least one fluid port; and removing the service module from the printer, wherein removing the service module from the printer causes the processor-readable medium of the service module to be disconnected from the processor of the printer.

15. The method of claim 14, further comprising:

connecting the at least one regular printing fluid cartridge to the at least one fluid port.

16. The method of claim 14, wherein the servicing fluid supply includes at least one of a shipping fluid or an unsaturated printing fluid.

17. The method of claim 14, wherein the servicing fluid has an air saturation level of less than about 70%.

18. The service module of claim 14, wherein the servicing fluid has an air saturation level of less than about 50%.

* * * * *